US012710209B2

(12) United States Patent
Delgado

(10) Patent No.: US 12,710,209 B2
(45) Date of Patent: Aug. 18, 2026

(54) ICEMAKER AND MOVABLE ICEMAKER COVER FOR A REFRIGERATOR APPLIANCE

(71) Applicant: Haier US Appliance Solutions, Inc., Wilmington, DE (US)

(72) Inventor: Alvaro Delgado, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 35 days.

(21) Appl. No.: 18/889,957

(22) Filed: Sep. 19, 2024

(65) Prior Publication Data

US 2026/0078939 A1 Mar. 19, 2026

(51) Int. Cl.
*F25C 1/24* (2018.01)

(52) U.S. Cl.
CPC ..... *F25C 1/24* (2013.01); *F25C 2400/10* (2013.01); *F25C 2600/04* (2013.01)

(58) Field of Classification Search
CPC ..... F25C 5/22; F25C 2400/10; F25C 1/24; F25D 2700/02
See application file for complete search history.

(56) References Cited

U.S. PATENT DOCUMENTS 6,050,097 A * 4/2000 Nelson ..... F25C 5/187 62/344
6,082,130 A * 7/2000 Pastryk ..... F25C 5/22 62/344
6,286,324 B1 * 9/2001 Pastryk ..... F25C 5/187 62/344
7,188,479 B2 * 3/2007 Anselmino ..... F25C 5/22 62/340
7,628,030 B2 12/2009 Visin et al.
8,671,711 B2 3/2014 Kim
9,709,312 B2 * 7/2017 Bertolini ..... F25C 5/185
10,323,876 B2 * 6/2019 Jeong ..... F25C 5/185
10,976,091 B2 4/2021 Kim
2006/0207282 A1 * 9/2006 Visin ..... F25D 23/12 62/351

(Continued)

FOREIGN PATENT DOCUMENTS

IN 201204071 I4 4/2014
JP 5142835 B2 2/2013
KR 20140122919 A * 10/2014 ..... F25D 23/04

*Primary Examiner* — Nelson J Nieves
(74) *Attorney, Agent, or Firm* — Dority & Manning, P.A.

(57) ABSTRACT

A refrigerator appliance includes a cabinet defining a receiving chamber; a cabinet door coupled to the cabinet to provide selective access to the receiving chamber; a cabinet door sensor configured to sense a position of the cabinet door; an icemaker positioned within the receiving chamber; an icemaker cover movably coupled with respect to the icemaker; and a controller operably coupled with each of the icemaker and the icemaker cover, the controller being configured to perform an operation. The operation includes determining that the icemaker is in an active icemaking mode; detecting, via the cabinet door sensor, a movement of the cabinet door from a closed position after determining that the icemaker is in the active icemaking mode; and moving the icemaker cover from an open state to a closed state in response to detecting the movement of the cabinet door from the closed position.

18 Claims, 6 Drawing Sheets

(56) References Cited

U.S. PATENT DOCUMENTS

| | | | | |
|---|---|---|---|---|
| 2010/0043456 | A1* | 2/2010 | Wu | F25D 23/12 62/340 |
| 2010/0126203 | A1* | 5/2010 | Kim | F25C 5/185 62/344 |
| 2010/0257889 | A1* | 10/2010 | Lee | F25C 1/24 62/344 |
| 2013/0327081 | A1* | 12/2013 | Son | F25C 5/20 62/344 |
| 2016/0131408 | A1* | 5/2016 | Bertolini | F25C 5/22 62/344 |
| 2023/0375247 | A1* | 11/2023 | Dos Santos, Jr. | F25D 23/028 |

* cited by examiner

ICEMAKER AND MOVABLE ICEMAKER COVER FOR A REFRIGERATOR APPLIANCE

FIELD OF THE INVENTION

The present subject matter relates generally to refrigerator appliances, and more particularly to built-in icemakers for refrigerator appliances.

BACKGROUND OF THE INVENTION

Refrigerator appliances generally include a cabinet forming a chilled chamber. The chilled chamber may be split into a fresh food portion and a freezer or freezing portion. Increasingly, refrigerator appliances incorporate built-in icemakers for forming ice shapes that may be dispensed or stored within the freezer portion. In some instances, the icemaker is positioned on an inside panel of a freezer cabinet door, such as adjacent to a through-the-door dispensing assembly.

Such built-in icemakers rely on cold air within the freezer portion to freeze water into ice shapes. Accordingly, some icemakers have exposed pieces, such as molds, trays, evaporator parts, or the like within the freezer portion to allow a maximum amount of cold air from the freezer chamber to contact the exposed pieces and more quickly freeze the ice shapes. However, having exposed parts presents several drawbacks. For one instance, if a user opens the chamber door, potential harmful contact between the user and the icemaker may result, leading to damage to one or more of the user or the icemaker. Additionally or alternatively, completely covering the icemaker may result in longer ice forming times, leading to dissatisfaction among users.

Accordingly, a movable icemaker cover that obviates one or more of the above-mentioned drawbacks would be beneficial. In particular, a selectively automatic retractable cover for an icemaker would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance defining a vertical direction, a lateral direction, and a transverse direction, including a cabinet defining a receiving chamber, a cabinet door coupled to the cabinet to provide selective access to the receiving chamber, a cabinet door sensor configured to sense a position of the cabinet door, an icemaker positioned within the receiving chamber or on the cabinet door, the icemaker being configured to selectively produce ice, an icemaker cover movably coupled with respect to the icemaker, and a controller operably coupled with each of the icemaker and the icemaker cover. The controller is configured to perform an operation, including determining that the icemaker is in an active icemaking mode, detecting, via the cabinet door sensor, a movement of the cabinet door from a closed position after determining that the icemaker is in the active icemaking mode, and moving the icemaker cover from an open state to a closed state in response to detecting the movement of the cabinet door from the closed position.

In another exemplary aspect of the present disclosure, a method of operating a refrigerator appliance is provided. The refrigerator appliance includes a cabinet defining a receiving chamber, a cabinet door coupled to the cabinet to provide selective access to the receiving chamber, a cabinet door sensor configured to sense a position of the cabinet door, an icemaker positioned within the receiving chamber or on the cabinet door, the icemaker being configured to selectively produce ice, and an icemaker cover movably coupled with respect to the icemaker. The method includes determining that the icemaker is in an active icemaking mode, detecting, via the cabinet door sensor, a movement of the cabinet door from a closed position after determining that the icemaker is in the active icemaking mode, and moving the icemaker cover from an open state to a closed state in response to detecting the movement of the cabinet door from the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
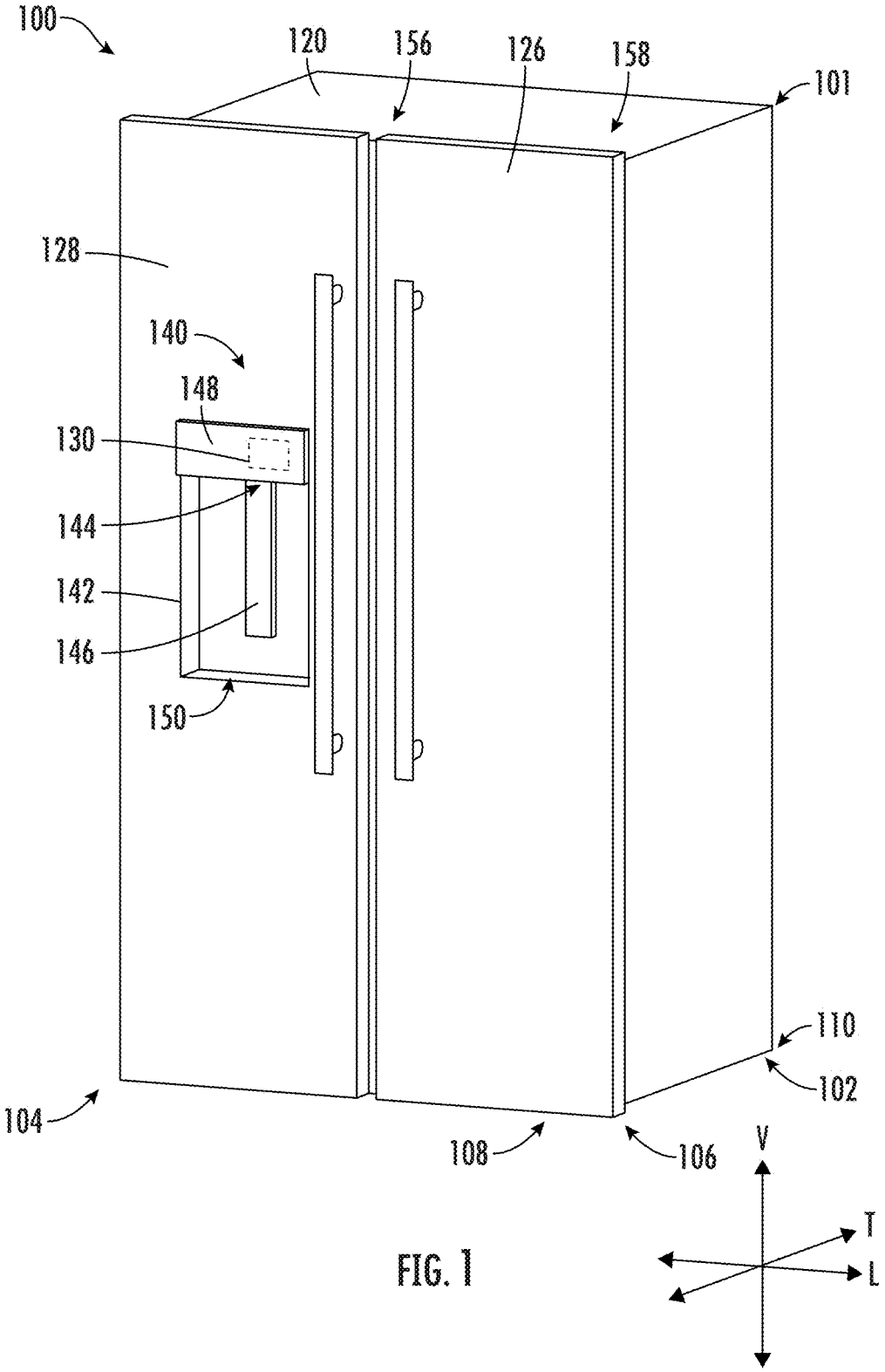
FIG. 1 provides a perspective view of a refrigerator appliance with cabinet doors in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
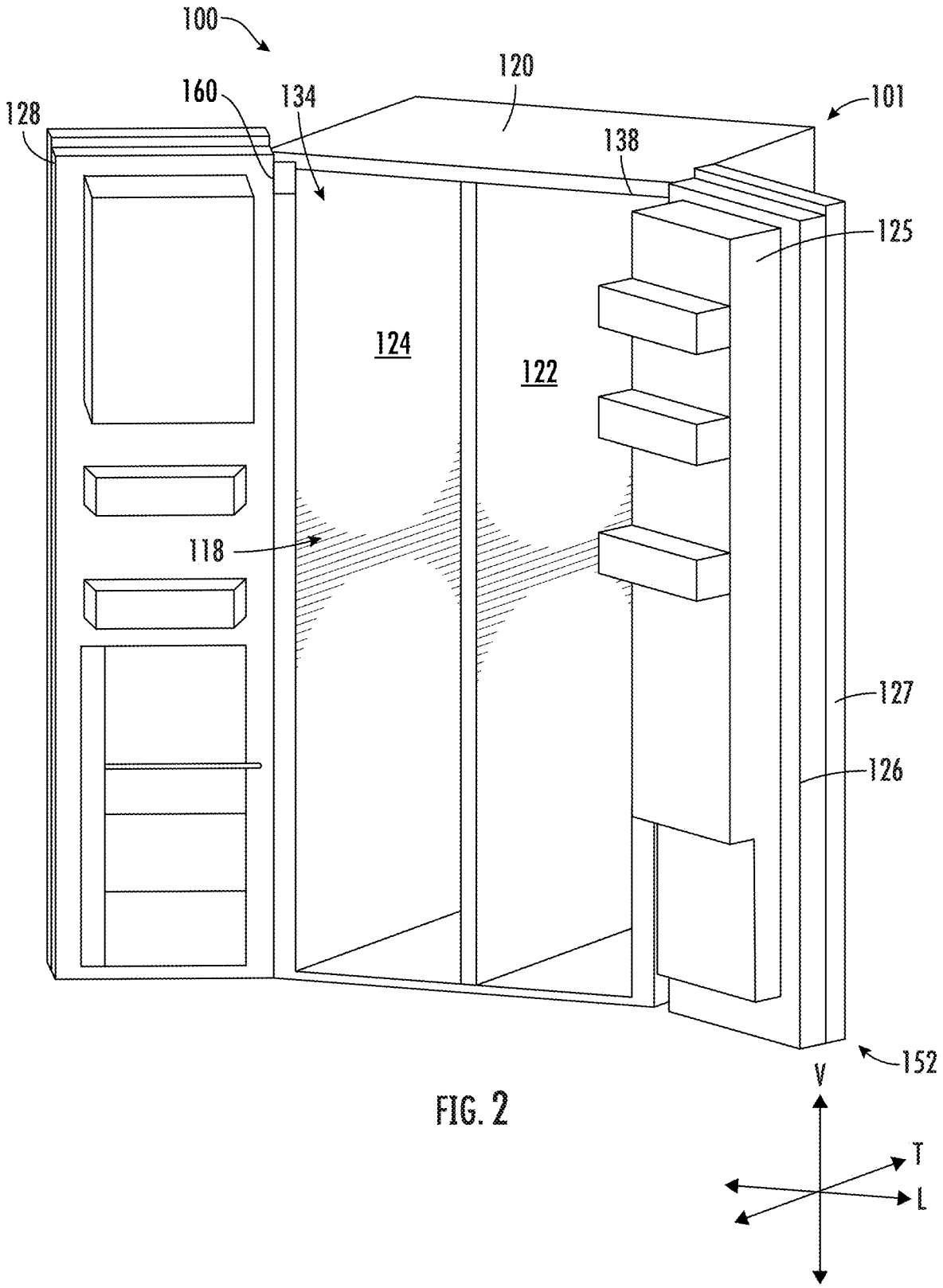
FIG. 2 provides a perspective view of the exemplary refrigerator appliance of FIG. 1 with cabinet doors in an open position.

FIGS. 1 and 2 provide perspective views of an exemplary refrigerator appliance 100 according to one or more embodiments of the present subject matter with doors 126, 128 (described in more detail below) closed in FIG. 1 and open in FIG. 2. Refrigerator appliance 100 defines a vertical direction V, a lateral direction L, and a transverse direction T, each mutually perpendicular to one another. As may be seen in FIGS. 1 and 2, refrigerator appliance 100 includes a cabinet or housing 120 that extends between a top 101 and a bottom 102 along a vertical direction V, between a left side 104 and a right side 106 along the lateral direction L, and between a front 108 and a rear 110 along the transverse direction T. Housing 120 defines a chilled chamber 118 for receipt of food items for storage. As used herein, the chamber may be "chilled" in that the chamber is operable at temperatures below room temperature, e.g., less than about seventy-five degrees Fahrenheit (75° F.). In particular, chilled chamber 118 may include a fresh food portion 122 and a freezer portion 124. For example, fresh food portion 122 may be operable within a temperature range above the freezing point of water and below room temperature, such as between approximately thirty-three degrees Fahrenheit (33° F.) and approximately sixty degrees Fahrenheit (60° F.). Also by way of example, freezer portion 124 may be operable within a temperature range including temperatures less than thirty-two degrees Fahrenheit (32° F.), such as between approximately thirty degrees Fahrenheit (30° F.) and approximately zero degrees Fahrenheit (0° F.). For example, a temperature of fresh food portion 122 may be between about thirty-four degrees Fahrenheit (34° F.) and about forty degrees Fahrenheit (40° F.) and a temperature of freezer portion 124 may be between about negative six degrees Fahrenheit (−6° F.) and about six degrees Fahrenheit (6° F.). Freezer portion 124 and fresh food portion 122 may be separated by a thermally insulated partition. For example, the partition may be a vertical partition, e.g., the partition may extend along the vertical direction V. The thermally insulated partition may permit or enhance operation of fresh food portion 122 and freezer portion 124 at distinct temperatures. One of ordinary skill in the art will recognize that chilled chamber 118 and the various portions thereof may be chilled by a sealed refrigeration system, such that chilled chamber 118, fresh food portion 122, and/or freezer portion 124 may be operable at or about the temperatures described above by providing chilled air from the sealed system. The structure and function of such sealed systems are understood by those of ordinary skill in the art and are not described in further detail herein for the sake of brevity and clarity.

Each of fresh food portion 122 and freezer portion 124 of chilled chamber 118 may extend along the vertical direction V between the top 101 and the bottom 102 of cabinet 120. A front portion of chilled chamber 118 may define an opening 138 for receipt of food items. Freezer portion 124 may be positioned adjacent to fresh food portion 122 (e.g., along the lateral direction L). For example, each of fresh food portion 122 and freezer portion 124 may extend from a bottom of chilled chamber 118 to a top of chilled chamber 118.

The refrigerator doors may include a fresh food door 126 and a freezer door 128 may be rotatably mounted, e.g., hinged, to an edge of housing 120 for selectively accessing fresh food portion 122 and freezer portion 124, respectively, of chilled chamber 118 within housing 120. Refrigerator doors 126 and 128 may be mounted to housing 120 at or near front portion 134 of chilled chamber 118 such that fresh food door 126 and freezer door 128 rotate between a closed position (FIG. 1) and an open position (FIG. 2). In the closed position of FIG. 1, doors 126 and 128 cooperatively sealingly enclose chilled chamber 118. Additionally, one or more gaskets and other sealing devices, which are not shown but will be understood by one of ordinary skill in the art, may be provided to promote sealing between doors 126 and 128 and cabinet 120. In the open position of FIG. 2, doors 126 and 128 permit access to each of fresh food portion 122 and freezer portion 124. Fresh food door 126 and freezer door 128 may be generally mirrored, e.g., the overall shape and size of each door 126 or 128 may be the same as the other door 126 or 128, with possible internal variations such as a dispenser recess 150. Moreover, although not specifically shown, doors 126 and 128 may be independently rotatable such that, e.g. fresh food door 126 may be in the open position while freezer door 128 is in the closed position, or vice versa.

Refrigerator appliance 100 may include a door sensor or door switch 160. Door sensor 160 may be provided at or near opening 138 (e.g., at front portion 134) and may detect an opening or a closing of fresh food door 126 or freezer door 128. For instance, two or more door sensors 160 may be included, with each door sensor 160 configured to detect a position of a dedicated door (e.g., fresh food door 126, freezer door 128, etc.). Additionally or alternatively, door sensor 160 may be positioned on freezer door 128, on fresh food door 126, on housing 120, or the like. Door sensor 160 may be a magnetic sensor, an optic sensor, a Hall sensor, a reed sensor, or the like. It should be noted that one or more sensors may be included, and that any combination of sensors or switches may be incorporated as door sensor 160.

Various storage components may be mounted within fresh food portion 122 and freezer portion 124 to facilitate storage of food items therein as will be understood by those skilled in the art. In particular, the storage components may include various combinations of bins, drawers, and shelves mounted within fresh food portion 122 and freezer portion 124. The bins, drawers, and shelves may be configured for receipt of food items (e.g., beverages and/or solid food items) and may assist with organizing such food items.

As may be seen in FIG. 1, refrigerator appliance 100 may include a dispensing assembly 140 for dispensing liquid water and/or ice. Dispensing assembly 140 may include a water dispenser 142 positioned on or mounted to an exterior portion of refrigerator appliance 100 (e.g., on one of doors 126 and 128, such as freezer door 128). Dispenser 142 may include a discharging outlet 144 for accessing ice and liquid water. An actuating mechanism 146, shown as a paddle, may be mounted below discharging outlet 144 for operating dispenser 142. In alternative exemplary embodiments, any suitable actuating mechanism may be used to operate dispenser 142. For example, dispenser 142 may include a sensor (such as an ultrasonic sensor) or a button rather than the paddle. A user interface panel 148 may be provided for controlling the mode of operation. For example, user interface panel 148 may include a plurality of user inputs (not labeled), such as a water dispensing button and an ice-dispensing button, for selecting a desired mode of operation such as crushed or non-crushed ice.

Discharging outlet 144 and actuating mechanism 146 may be formed as an external part of dispenser 142 and may thus be mounted in dispenser recess 150. Dispenser recess 150 may be positioned on an exterior side or face of one of the refrigerator doors 126 and 128 (e.g., freezer door 128), at a predetermined elevation convenient for a user to access ice or water and enabling the user to access ice without the need to bend-over and without the need to open doors 126 and 128. In the exemplary embodiment, dispenser recess 150 is positioned at a level that approximates the chest level of a user, though other positions are possible and within the scope of the present subject matter.

Appliance 100 may further include or be in operative communication with a processing device or a controller 130 that may be generally configured to facilitate appliance operation. In this regard, user interface panel 148, certain user input devices, a display, and the like may be in communication with controller 130 such that controller 130 may receive control inputs from user interface panel 148, may display information using the display, and may otherwise regulate operation of appliance 100. For example, signals generated by controller 130 may operate appliance 100, including any or all system components, subsystems, or interconnected devices, in response to the position of user interface panel 148 and other control commands. User interface panel 148 and other components of appliance 100 may be in communication with controller 130 via, for example, one or more signal lines or shared communication busses. In this manner, Input/Output ("I/O") signals may be routed between controller 130 and various operational components of appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 130 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 130 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 130 may be operable to execute programming instructions or micro-control code associated with an operating cycle of appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 130 as disclosed herein is capable of and may be operable to perform any methods, method steps, or portions of methods as disclosed herein. For example, in some embodiments, methods disclosed herein may be embodied in programming instructions stored in the memory and executed by controller 130.

The memory devices may also store data that can be retrieved, manipulated, created, or stored by the one or more processors or portions of controller 130. The data can include, for instance, data to facilitate performance of one or more methods. The data can be stored locally (e.g., on controller 130) in one or more databases and/or may be split up so that the data is stored in multiple locations. In addition, or alternatively, the one or more database(s) can be connected to controller 130 through any suitable network(s), such as through a high bandwidth local area network (LAN) or wide area network (WAN). In this regard, for example, controller 130 may further include a communication module or interface that may be used to communicate with one or more other component(s) of appliance 100, controller 130, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 3:
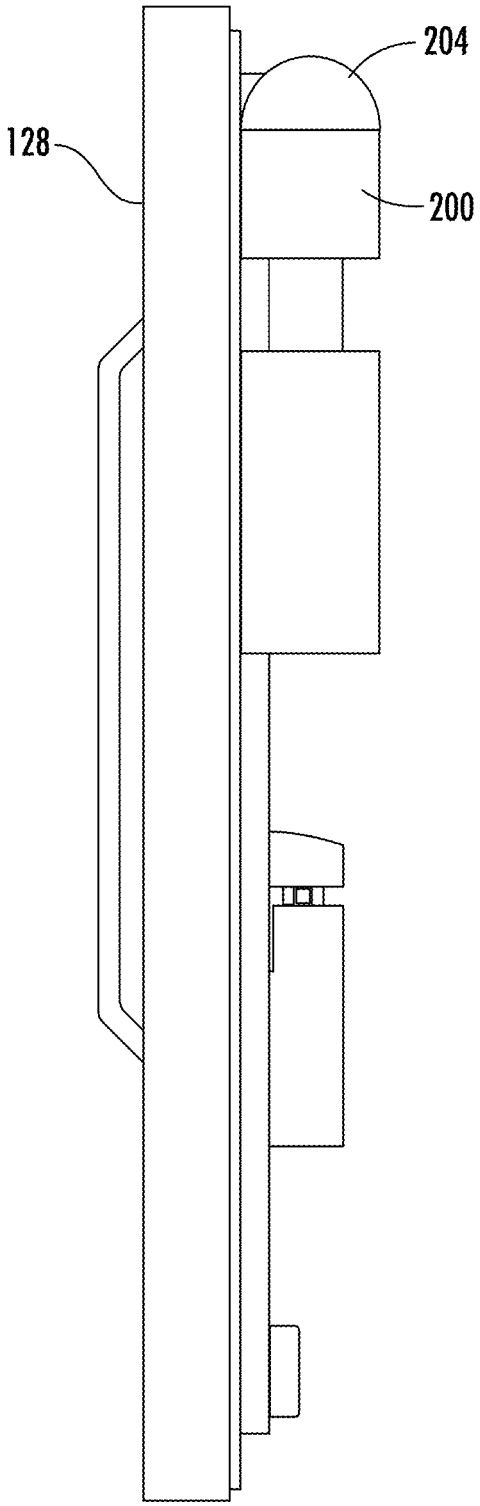
FIG. 3 provides a side view of a freezer chamber door of the exemplary refrigerator appliance of FIG. 1 showing an icemaker and icemaker cover in a closed position.
Figure 4:
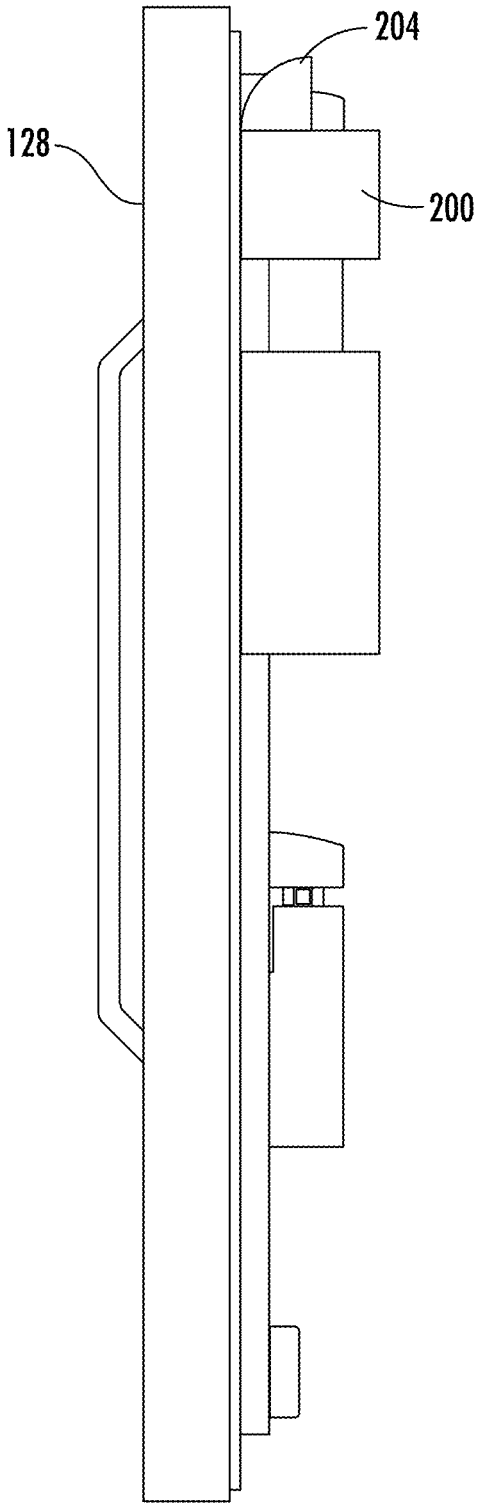
FIG. 4 provides a side view of the exemplary freezer chamber door of FIG. 3 showing the icemaker and icemaker cover in an open position.
Figure 5:
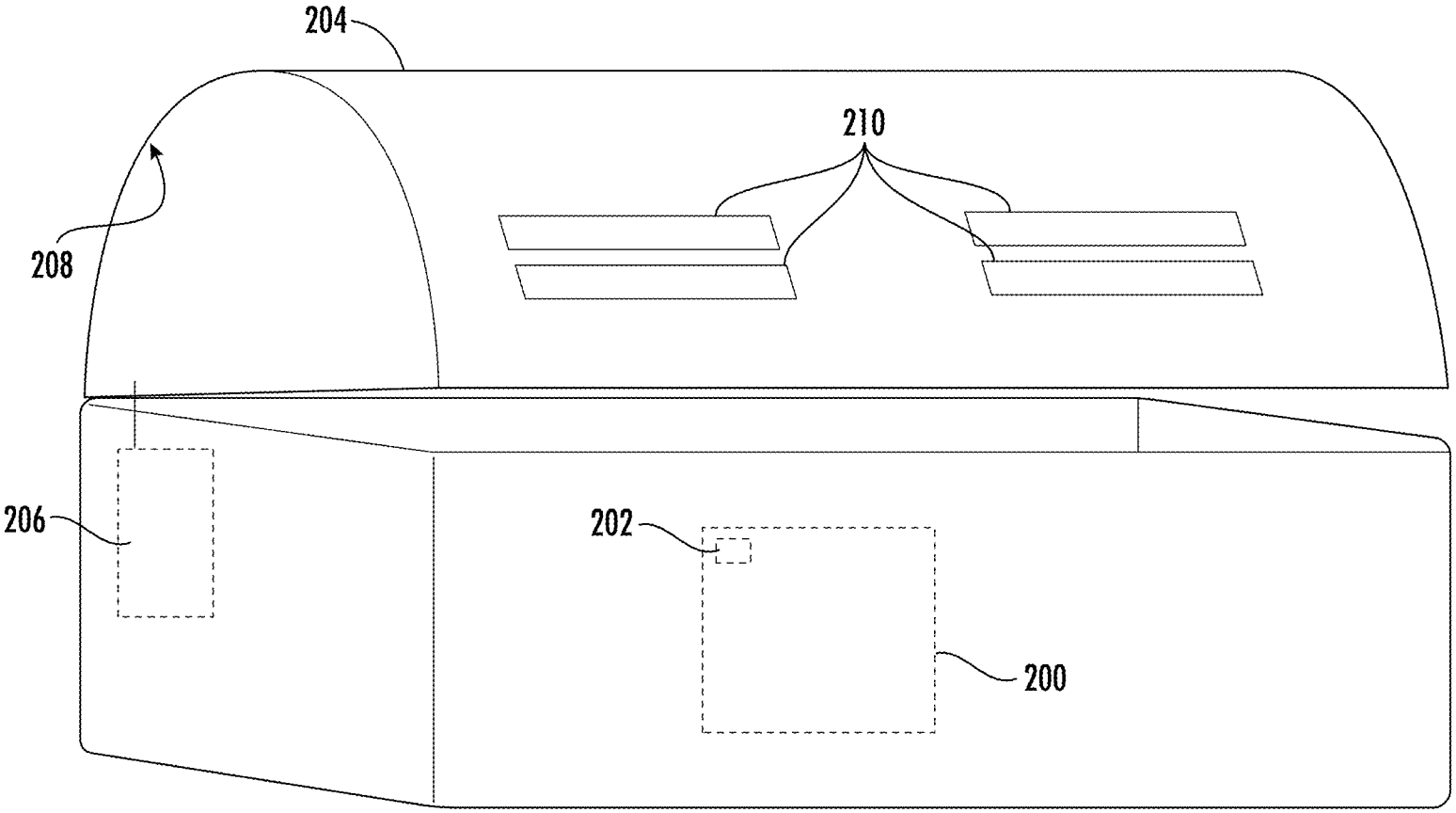
FIG. 5 provides a schematic perspective view of an exemplary icemaker and icemaker cover according to exemplary embodiments of the present disclosure.

Referring now to FIGS. 3 through 5, an icemaker including a retractable or openable icemaker cover or door will be described in detail. In detail, refrigerator appliance 100 may include an icemaker 200. Icemaker 200 may be positioned within chilled chamber 118. For instance, icemaker 200 may be positioned within freezer portion 124 of chilled chamber 118. According to at least some embodiments, icemaker 200 is positioned on or attached to a cabinet door (e.g., freezer door 128). Icemaker 200 may be configured to selectively produce ice which may then be distributed via dispensing assembly 140. Icemaker 200 may be any suitable style of icemaker, for instance, a traditional tray style ice maker, a clear icemaker, a nugget icemaker, a craft icemaker, or the like. Accordingly, icemaker 200 may be selectively connected to a water source to receive water for the forming of ice.

Icemaker 200 may include a temperature sensor 202. For instance, temperature sensor 202 may be positioned within icemaker 200. Temperature sensor 202 may be configured to measure, sense, monitor, or otherwise determine a temperature of icemaker 200. Additionally or alternatively, temperature sensor 202 may be configured to measure or monitor a temperature of a mold, tray, frame, or other feature in or on which ice is formed.

As used herein, "temperature sensor" or the equivalent is intended to refer to any suitable type of temperature measuring system or device positioned at any suitable location for measuring the desired temperature. Thus, for example, temperature sensor 202 may each be any suitable type of temperature sensor, such as a thermistor, a thermocouple, a resistance temperature detector, a semiconductor-based integrated circuit temperature sensors, etc. In addition, temperature sensor 202 may be positioned at any suitable location and may output a signal, such as a voltage, to a controller that is proportional to and/or indicative of the temperature being measured. Although exemplary positioning of temperature sensors is described herein, it should be appreciated that appliance 100 may include any other suitable number, type, and position of temperature, humidity, and/or other sensors according to alternative embodiments.

Appliance 100 may include an icemaker cover 204. Icemaker cover 204 may be movably coupled with respect to icemaker 200. Icemaker cover 204 may be configured to selectively cover, overhang, or otherwise enclose icemaker 200 (e.g., within freezer portion 124). For instance, icemaker cover 204 may prohibit access (e.g., via a user's hand) to icemaker 200 or any functional pieces thereof, including any molds, trays, frames, or otherwise attached to or part of icemaker 200. Thus, icemaker cover 204 may be at least partially positioned above icemaker 200 along the vertical direction V.

Icemaker cover 204 may be moveable between an open state and a closed state. In detail, when in the closed state, icemaker cover 204 may completely cover icemaker 200 such as to restrict user access thereto. Accordingly, when in the open state, icemaker cover 204 may be retracted, folded, moved, or otherwise repositioned so as to allow access (e.g., user access) thereto. Additionally or alternatively, when in the open position, air flow to icemaker 200 may be maximized. Thus, cold or chilled air from freezer portion 124 may be more easily supplied to icemaker 200, as will be described below.

Appliance 100 may include a motor or motor assembly 206. Motor 206 may be operably coupled with icemaker cover 204. Moreover, motor 206 may be operably coupled with controller 130 or any other suitable controller (e.g., such as an onboard controller). Thus, motor 206 may receive signals from controller 130 to selectively move icemaker cover 204 between the open state and the closed state (e.g., according to one or more input signals). For example, motor 206 may include a brushless DC electric motor, a stepper motor, or any other suitable type or configuration of motor. For example, motor 206 may include an AC motor, an induction motor, a permanent magnet synchronous motor, or any other suitable type of AC motor. In addition, motor 206 may include any suitable transmission assemblies, clutch mechanisms, or other components.

Icemaker cover 204 may define an interior surface 208. Interior surface 208 may face icemaker 200 (e.g., when icemaker cover 204 is in the closed position). Interior surface 208 may have a concave curvature. For instance, icemaker cover 204 may have a semicylindrical shape facing toward icemaker 200. Interior surface 208 may direct cold air from chilled chamber 118 (e.g., freezer portion 124) toward icemaker 200, for instance, when icemaker cover 204 is in the open position. As described above, icemaker cover 204 may rotate into the open position. As seen particularly in FIG. 4, icemaker cover 204 may resemble a quarter cylindrical panel. As the cold air moves toward icemaker 200 (e.g., along the transverse direction T), the air may be directed downward toward icemaker 200 via interior surface 208.

Icemaker cover 204 may include or define one or more openings 210. For instance, the one or more openings 210 may be referred to as vents, louvres, registers, slits, gaps, or the like. Hereinafter, a single opening 210 will be described with the understanding that the description applies to any suitable number of openings 210. Opening 210 may allow airflow between an icemaker chamber (e.g., in which icemaker 200 is accommodated) and chilled chamber 118 (e.g., freezer portion 124). For instance, opening 210 may be a cut-out portion of icemaker cover 204 (e.g., defined through interior surface 208). Opening 210 may include adjusting features. For instance, opening 210 may include a flap or door rotatably attached thereto to selectively adjust an amount or flow of air therethrough.

Figure 6:
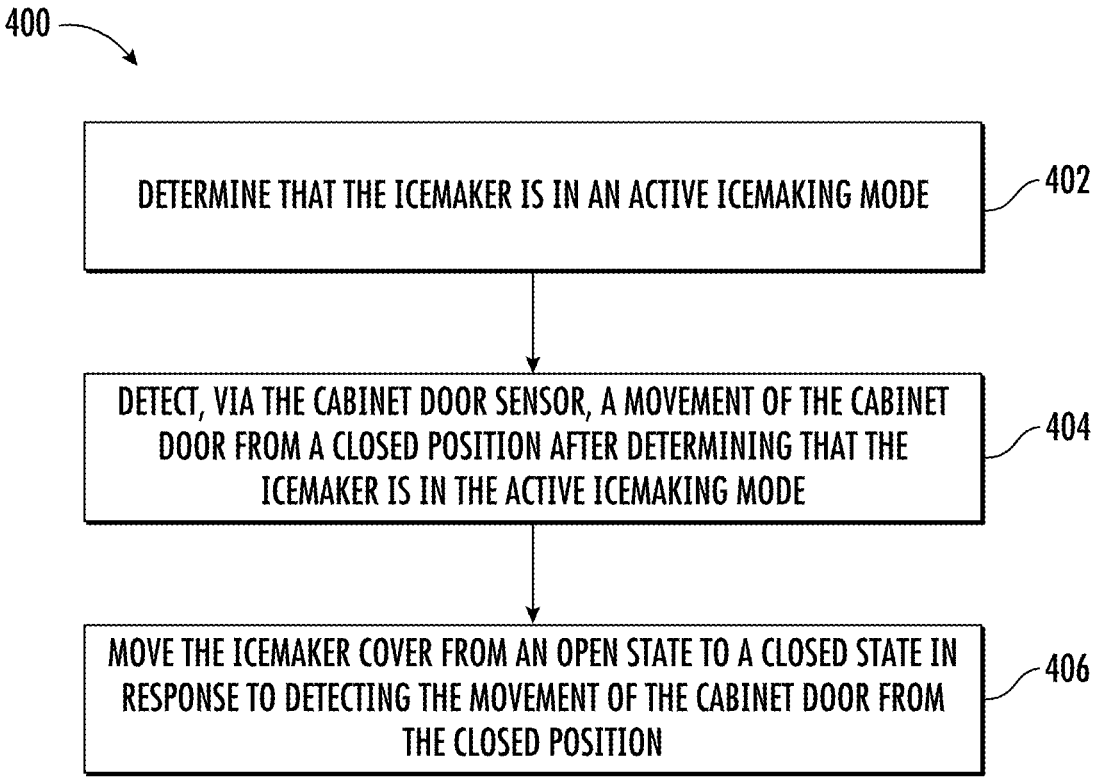
FIG. 6 provides a flowchart illustrating a method of operating a refrigerator appliance according to exemplary embodiments of the present disclosure.

Now that the general descriptions of an icemaker and an icemaker cover have been described, a method 400 of operating an icemaker cover (e.g., icemaker cover 204) will be described in detail with reference to FIG. 6. Method 400 may be performed by an onboard controller (e.g., controller 130), or a separate dedicated controller. Although method 400 refers in general to icemaker cover 204, it should be understood that method 400 may be applied to any suitable icemaker and/or icemaker cover capable of performing the same or similar motions, actions, responses, and the like.

At step 402, method 400 may include determining that the icemaker is in an active icemaking mode. In detail, the icemaker (e.g., icemaker 200) may be operable between an active mode in which ice is actively being frozen into desired shapes, and an inactive mode in which a tray, mold, or the like is empty, and the refrigeration system is inactive (e.g., not circulating refrigerant). At this point, the icemaker cover (e.g., icemaker cover 204) may be in the open state. For instance, the icemaker cover is not covering, blocking, or otherwise impeding access to the icemaker elements, such as the mold, tray, evaporator, or the like.

In determining that the icemaker is in the active icemaking mode, method 400 may receive one or more temperature signals from a temperature sensor (e.g., temperature sensor 202). For instance, the temperature sensor may periodically obtain a temperature measurement of the icemaker (e.g., the tray or mold of the icemaker) and send the obtained temperature signals to the controller. The one or more obtained temperature signals may then be analyzed by the controller. For instance, method 400 may include determining that a temperature signal of the one or more temperature signals is within a predetermined temperature range. The predetermined temperature range may be referred to as a freezing range. Thus, when the temperature at the icemaker is determined to be within the predetermined temperature range, method 400 may determine that the icemaker is in the active icemaking mode.

At step 404, method 400 may include detecting a movement of the cabinet door from a closed position after determining that the icemaker is in the active icemaking mode. As mentioned above, the refrigerator appliance may include a cabinet door (e.g., freezer door 128) movable between a closed position (e.g., in which the receiving chamber or chilled chamber is sealed) and an open position. The appliance may include a door sensor or switch configured to sense, monitor, or otherwise determine a position of the cabinet door. Accordingly, the door sensor may be triggered when the cabinet door is moved from the sealed or closed position. For instance, the degree of openness may be neglected such that as soon as the door is unsealed (e.g., from the cabinet of the refrigerator appliance), the door sensor is triggered.

At step 406, method 400 may include moving the icemaker cover from the open state to the closed state. In detail, in response to detecting the movement of the cabinet door from the closed position, a motor (e.g., motor 206) may initiate a movement of the icemaker cover. As mentioned above, when the icemaker is in the active icemaking mode, the icemaker cover may assume a natural position of the open state. The icemaker cover may remain in the open state when the cabinet door is in the closed position. Accordingly, when the cabinet door is opened, the icemaker cover may be moved to the closed state.

As mentioned above, the icemaker cover may be rotatable, slidable, collapsible, or otherwise movable to allow selective access to the icemaker. In some instances, the icemaker cover includes a feedback sensor. The feedback sensor may be attached to one of the icemaker cover itself or a portion of the motor or motor assembly controlling a movement of the icemaker cover. The feedback sensor may be configured to determine or sense a position of the icemaker cover (e.g., with respect to the icemaker or a receiving chamber of the icemaker). For instance, the feedback sensor may determine when the icemaker cover is moved into the closed position and stop a rotation or movement of the motor when the icemaker cover reaches a fully closed position. Similarly, the feedback sensor may determine when the icemaker cover is moved into the open position and stop a rotation or movement of the motor when the icemaker cover reaches a fully open position.

Method 400 may further include detecting a movement of the cabinet door to the closed position. In detail, after moving the icemaker cover from the open state to the closed state, method 400 may determine that the cabinet door has returned to the fully closed or sealed position with respect to the cabinet. Once the cabinet door is in the fully closed position, method 400 may further determine that the icemaker is still in the active icemaking mode. Thereafter, method 400 may move the icemaker cover from the closed state to the open state after detecting the movement of the cabinet door to the closed position.

According to some embodiments, method 400 may include determining that the icemaker is inactive (e.g., not in the active icemaking mode). In response to determining that the icemaker is inactive, method 400 may include moving the icemaker cover from the open state to the closed state. For instance, whenever the icemaker is not actively making or forming ice, the natural state of the icemaker cover may be the closed state. Thus, method 400 may further include detecting a movement of the cabinet door to the closed position. Additionally or alternatively, method 400 may include determining that the cabinet door is maintained in the closed position. Method 400 may then maintain the icemaker cover in the closed state after detecting the movement of the cabinet door to the closed position, or determining that the cabinet door is maintained in the closed position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet defining a receiving chamber;

a cabinet door coupled to the cabinet to provide selective access to the receiving chamber;

a cabinet door sensor configured to sense a position of the cabinet door;

an icemaker positioned within the receiving chamber or on the cabinet door, the icemaker being configured to selectively produce ice;

an icemaker cover movably coupled with respect to the icemaker; and a controller operably coupled with each of the icemaker and the icemaker cover, the controller being configured to perform an operation, the operation comprising:

determining that the icemaker is in an active icemaking mode;

detecting, via the cabinet door sensor, a movement of the cabinet door from a closed position after determining that the icemaker is in the active icemaking mode;

moving the icemaker cover from an open state to a closed state in response to detecting the movement of the cabinet door from the closed position;

determining that the icemaker is inactive; and moving the icemaker cover from the open state to the closed state in response to determining that the icemaker is inactive.

2. The refrigerator appliance of claim 1, wherein the operation further comprises:

detecting a movement of the cabinet door to the closed position after moving the icemaker cover from the open state to the closed state; and moving the icemaker cover from the closed state to the open state after detecting the movement of the cabinet door to the closed position.

3. The refrigerator appliance of claim 1, further comprising:

a motor coupled with the icemaker cover to electively move the icemaker cover between the open state and the closed state, the motor being operably coupled with the controller.

4. The refrigerator appliance of claim 1, further comprising:

a temperature sensor positioned within the icemaker.

5. The refrigerator appliance of claim 4, wherein determining that the icemaker is in the active icemaking mode comprises:

receiving a temperature signal from the temperature sensor; and determining that the temperature signal indicates a temperature within the icemaker is within a predetermined temperature range.

6. The refrigerator appliance of claim 1, wherein the icemaker cover is at least partially positioned over the icemaker along the vertical direction.

7. The refrigerator appliance of claim 1, wherein the icemaker is mounted to the cabinet door.

8. The refrigerator appliance of claim 1, wherein the operation further comprises:

detecting a movement of the cabinet door to the closed position after determining that the icemaker is inactive; and maintaining the icemaker cover in the closed state after detecting the movement of the cabinet door to the closed position.

9. The refrigerator appliance of claim 1, wherein the icemaker cover comprises an interior surface, the interior surface having a concave curvature to direct cold air from the receiving chamber toward the icemaker when the icemaker cover is in the open state.

10. A method of operating a refrigerator appliance, the refrigerator appliance comprising a cabinet defining a receiving chamber, a cabinet door coupled to the cabinet to provide selective access to the receiving chamber, a cabinet door sensor configured to sense a position of the cabinet door, an icemaker positioned within the receiving chamber or on the cabinet door, the icemaker being configured to selectively produce ice, and an icemaker cover movably coupled with respect to the icemaker, the method comprising:

determining that the icemaker is in an active icemaking mode;

detecting, via the cabinet door sensor, a movement of the cabinet door from a closed position after determining that the icemaker is in the active icemaking mode;

moving the icemaker cover from an open state to a closed state in response to detecting the movement of the cabinet door from the closed position;

determining that the icemaker is inactive; and moving the icemaker cover from the open state to the closed state in response to determining that the icemaker is inactive.

11. The method of claim 10, further comprising:

detecting a movement of the cabinet door to the closed position after moving the icemaker cover from the open state to the closed state; and moving the icemaker cover from the closed state to the open state after detecting the movement of the cabinet door to the closed position.

12. The method of claim 10, wherein the refrigerator appliance further comprises:

a motor coupled with the icemaker cover to electively move the icemaker cover between the open state and the closed state, the motor being operably coupled with the controller.

13. The method of claim 10, wherein the refrigerator appliance further comprises:

a temperature sensor positioned within the icemaker.

14. The method of claim 13, wherein determining that the icemaker is in the active icemaking mode comprises:

receiving a temperature signal from the temperature sensor; and determining that the temperature signal indicates a temperature within the icemaker is within a predetermined temperature range.

15. The method of claim 10, wherein the icemaker cover is at least partially positioned over the icemaker along the vertical direction.

16. The method of claim 10, wherein the icemaker is mounted to the cabinet door.

17. The method of claim 11, further comprising:

detecting a movement of the cabinet door to the closed position after determining that the icemaker is inactive; and maintaining the icemaker cover in the closed state after detecting the movement of the cabinet door to the closed position.

18. The method of claim 10, wherein the icemaker cover comprises an interior surface, the interior surface having a concave curvature to direct cold air from the receiving chamber toward the icemaker when the icemaker cover is in the open state.

* * * * *